United States Patent [19]

Vaubel

[11] Patent Number: 4,566,523

[45] **Date of Patent: * Jan. 28, 1986**

[54] ADJUSTABLE SLIDING MOLD FOR MULTIPLE-STRAND CASTING DEVICES

[75] Inventor: Gert Vaubel, Warburg, Fed. Rep. of Germany

[73] Assignee: Benteler-Werke AG Werk Neuhaus, Paderborn, Fed. Rep. of Germany

[ * ] Notice: The portion of the term of this patent subsequent to Nov. 6, 2001 has been disclaimed.

[21] Appl. No.: 500,761

[22] Filed: Jun. 3, 1983

[30] Foreign Application Priority Data

Jun. 28, 1982 [DE] Fed. Rep. of Germany ..... 3224065

[51] Int. Cl.[4] ..... B22D 11/00

[52] U.S. Cl. ..... 164/420; 164/436; 164/491

[58] Field of Search ..... 164/418, 420, 436, 459, 164/491; 425/150, 186, 192 R, 224, 380, 381, 432, 441, 451; 264/70

[56] References Cited

U.S. PATENT DOCUMENTS 3,717,197 2/1973 Strack et al. ..... 164/420

*Primary Examiner*—Nicholas P. Godici
*Assistant Examiner*—Richard K. Seidel
*Attorney, Agent, or Firm*—Michael J. Striker

[57] ABSTRACT

An adjustable slide mold for twin casting installations includes two angular mold parts slidably engaging each other at two contact surfaces. At least one of the mold parts is formed with a projecting arm engaging the opposite mold part at an additional contact surface to divide the extrusion channel into a plurality of parallel extrusion passages. The mold parts are connected to an adjusting drive which uniformly displaces the mold parts relative to each other in opposite directions, so that the centers of respective extrusion passages remain stationary irrespective of the adjustment of their cross-sectional areas.

8 Claims, 5 Drawing Figures

ADJUSTABLE SLIDING MOLD FOR MULTIPLE-STRAND CASTING DEVICES

BACKGROUND OF THE INVENTION

The invention relates to an adjustable mold for use in continuous casting installations for producing cast strands of substantially rectangular cross section. The mold is assembled of at least two mold parts which, in order to adjust the cross section of the cast strand, are mutually shiftable transversely to the direction of extrusion.

When it is desired to change the cross section of a cast strand, in conventional continuous casting installations it is necessary to install another sliding mold of the desired size. The disadvantage of such a prior-art mold adjustment is not only the fact that a relatively large number of expensive molds, made usually of copper and provided with cooling channels, must have been kept ready for immediate use, but also the exchange required considerable installation time, resulting in relatively long down times of the entire casting installation.

An adjustable sliding mold is known from the Swiss Pat. No. 386,629, disclosing two relatively broad mold walls arranged opposite each other and engaging a pair of opposite mold parts arranged at right angles to the mold walls to complete an extrusion channel of rectangular cross section. The clearance between the mold parts is adjustable by means of spindles of an adjusting device. It has been found, however, that problems occur in prior-art molds of this kind relating to the seal between the mating surfaces of the movable and fixed mold parts. The four contact surfaces must be carefully machined with relatively great expenditures to ensure satisfactory operation of the casting device.

An improvement of this known adjustable sliding mold, relating particularly to the aforementioned sealing problem, has been devised in applicant's prior application Ser. No. 471,146, which discloses sliding molds consisting of two mutually shiftable mold parts, each having an L-shaped profile to define a rectangular channel of adjustable cross section. A particularity of this design is the provision of an arcuate guiding surface formed on the outer wall of at least one mold part, so that, in the case of casting strands of larger cross section, the conicity of the channel can be increased. This solution is applicable both to sliding molds having flat inner surfaces and for sliding molds having curved inner surfaces (circular segment molds). This prior-art solution, however, is suitable for casting a single strand only.

SUMMARY OF THE INVENTION

An objective of this invention is to provide a sliding mold of the aforedescribed kind which permits simultaneous casting of several continuous strands.

In keeping with this object and others which will become apparent hereafter, one feature of the invention resides in the provision of at least two angular (L-shaped) mold parts slidably engaging each other at two contact surfaces to form together an extrusion channel of a substantially rectangular cross section, at least one of the mold parts being formed with at least one partition bisecting the extrusion channel and slidably engaging the opposite mold at an opposite contact surface to subdivide the channel into a plurality of parallel extrusion passages.

It is true that the so-called twin casting devices for producing parallel cast strands are known from prior art; nevertheless, the application of slide molds of conventional construction frequently requires large installation space. For example, in the aforementioned prior-art sliding mold with two fixed opposite walls and with the adjustable lateral mold parts, it is required that an adjusting device be assigned to each of the two adjustable parts. In twin installations, however, where two slide molds have been arranged side-by-side, it has been necessary to provide two adjusting devices between the molds. As a consequence, the total width of the installation becomes excessively large, and frequently does not fit in the available space.

In the twin mold according to this invention, no separate adjusting devices are used between the parallel extrusion passages. This feature makes it possible to construct the multiple-strand casting mold as a particularly compact unit. In particular, it is now possible to convert a single-channel sliding mold into a multiple-strand casting mold, particularly in a twin-channel unit, without any requirements for an additional installation space.

In a preferred embodiment of this invention, one of the sliding mold parts has approximately a T-shaped profile, and the other mold part has a U-shaped profile. The arms of the U-shaped mold part correspond in height to the leg of the T-shaped mold part and engage the aligned arms of the T-shaped mold at two contact points, while the leg of the T-shaped part divides the extrusion channel into two parallel extrusion passages. In this preferred embodiment, similarly as in the aforedescribed single-channel sliding mold, there are employed only two mold parts and only three contact surfaces between the two mutually shiftable parts are needed. As a consequence, the two mold parts can be readily pressed against one another without the danger of any leakage between the contact surfaces. If the leg of the T-shaped mold part intersects the U-shaped mold part at its plane of symmetry, the resulting parallel extrusion passages have the same cross section. In all other adjusting positions, the cross section of the extrusion passages differs from one another.

A particular advantage of this embodiment is the fact that the intake amount of the molten material for the whole multiple-strand mold is always constant, inasmuch as the sum of the two variable cross-sectional areas of the extrusion passages is the same in any adjusting position.

In another advantageous embodiment of this invention, the cross-sectional area of the extruded strands is adjusted by slidably displacing in opposite directions both mold parts about the same distance relative to each other. In this manner, it is achieved that the loading of the molten metal takes place always in the center of the two parallel extrusion passages. This feature is of importance, inasmuch as difficulty might arise in the case when, in the course of adjusting the mold, the fed in stream of molten metal is directed not to the center of the cross section of the passage but to its marginal area. In this case, undesired turbulence might result, which might impair the requisite fast cooling process of the cast strand. The multiple-strand casting installation according to this invention, similarly as applicant's single-strand casting installation according to patent application Ser. No. 471,146, can be used for sliding molds having both flat and curved inner surfaces. Also, the arc-shaped guiding cam for adjusting the conicity of the extrusion channel in the case of larger cross-sectional areas of the discharged strand is applicable in the multiple-passage arrangement of this invention.

According to a modification of this invention, suitable particularly for designing an adjustable twin mold installation for casting parallel cast strands of the same cross section, each mold part has an F-shaped profile with arms of equal length interleaving the arms of the opposite mold part. In this modification of mold parts, there are altogether three parallel extrusion passages for the simultaneous production of cast strands. The lateral extrusion passages are of the same cross section in any adjusted position of the mold parts, and therefore this embodiment is particularly suitable as a twin extruder in which only the two lateral passages are used in production. This embodiment offers an additional advantage in that, irrespective of the number of extrusion channels used, the center axis of the extruded or cast strand always coincides with the center of each passage, provided that both mold parts are displaced about the same distances in opposite directions relative to one another.

The last mentioned embodiment, using F-shaped mold parts, has altogether four contact surfaces. This increased number of contact surfaces may under certain circumstances cause problems when, in order to ensure a perfect seal between the contact surfaces, a relatively large force must be applied from both sides on the two sliding mold parts.

In order to avoid this difficulty when the casting installation is employed as a twin casting device, at least one of the F-shaped sliding mold parts is assembled of two L-shaped sections linked together by means of a flexible coupling for example, whereby each of the L-shaped sections is pressed against the opposite mold part by separate compression devices, for example by means of springs.

In order to achieve compensation for reduction of the cross-sectional area of the extrusion passages, caused for example due to shrinkage and being of importance particularly in view of cooling effects, contemporary molds are practically all made with conically configured extrusion passages. When the multi-strand slidable mold of this invention is also shaped with conically converging extrusion passages and with guiding elements such as arcuate guiding grooves on one mold part matching the variations of the conicity at different cross sections of the channel, it is advantageous when the extrusion passages converge in the direction of shifting of the upright arms of the mold parts. In this manner, a sufficient conicity is obtained even in the "zero position" of the mold parts.

It has been already mentioned that, in the mold according to this invention, conventional adjusting devices between the individual extrusion passages are eliminated. In this manner, an extremely compact construction of the entire casting installation is achieved. In comparison with known installations of this kind, the adjusting and driving devices for the individual parts of the adjustable mold are installed in a plane intersecting the extrusion passages; that means, they are arranged on the broad side of the mold. The compactness of the installation is, according to another feature of this invention, still further improved by mounting the driving devices for adjusting the position of the mold parts at right angles relative to the displacement direction and when the driving devices engage the longer sides of the mold parts.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
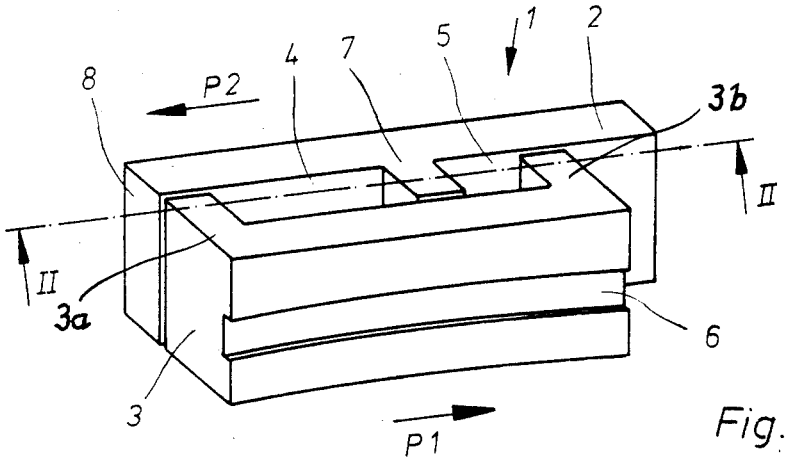
FIG. 1 is a perspective view of one embodiment of the slidable mold of this invention.

The adjustable sliding mold 1 depicted in FIG. 1 is designed for use in a twin casting installation for simultaneously producing two cast strands of a substantially rectangular cross section. The mold 1 is assembled of two mold parts 2 and 3 which, in order to change the cross section of respective cast strands, are shiftable relative to each other transversely to the direction of casting. When the two mold parts 2 and 3 are uniformly shifted in opposite directions, indicated by arrows P1 and P2, the cross-sectional area of the extrusion passage 4 is reduced, while the cross-sectional area of the other extrusion passage 5 increases. The outer wall of mold part 3 is formed with an arcuate guiding groove 6 slidably engaging a correspondingly shaped guiding projection **6*a* (FIG. 2), so that upon shifting the mold parts a predetermined change of the conicity of respective extrusion passages 4 and 5 is changed in dependence on the adjusted cross section of the two extrusion passages. The details of the guiding means 6 and 6*a* are disclosed in the aforementioned application Ser. No. 471,146 of the present inventor, and therefore need not be further explained. It will be seen from FIGS. 1 and 3 that, in this embodiment, the mold part 2 has a T-shaped profile, whereas the mold part 3 has a U-shaped profile. The arms 3*a* and 3*b* of mold part 3 slidably engage surface portions of the other mold part 2 at both sides of its central arm 7. The end face of arm 7 engages a surface portion of the inner wall of mold part 3 and hence divides the area between the two arms 3*a* and 3*b* into two parallel extrusion passages 4 and 5**.

Figure 2:
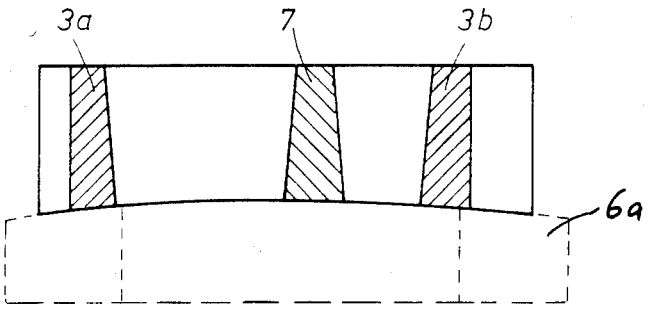
FIG. 2 is a sectional side view of the mold of FIG. 1, taken along the line II—II.

Referring again to FIG. 2, the side walls of the arm 7 of the mold part 2 and the arms **3*a* and 3*b* of the mold part 3 diverge in transverse direction and are conically extended downwardly. The guiding projection 6*a* in FIG. 2 is indicated only schematically by dashed lines, and as mentioned before its bearing surface matches the curvature of the guiding groove 6**.

Figure 3:
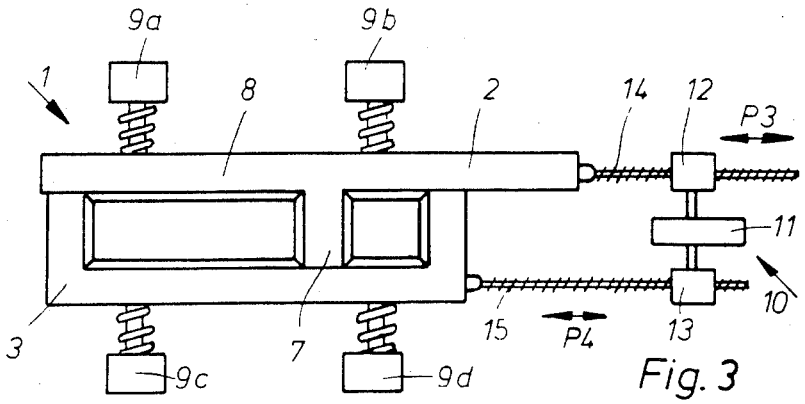
FIG. 3 is a top view of the sliding mold according to FIG. 1, shown with compression springs and with an adjusting drive.

FIG. 3 shows the sliding mold of FIG. 1 in its assembled condition. The two sliding mold parts 2 and 3 are pressed together by springs **9*a*–9*d* at a force sufficient to prevent any leakage between the contact surfaces of the mold parts. A position-adjusting drive 10 includes a driving motor 11 connected via a shaft to transmission gears 12 and 13 coupled respectively to spindles 14 and 15. The transmission gears 12 displace the spindle 14 in opposite direction (arrow P3) than in the direction of displacement (arrow P4) of the spindle 15. The adjusting drive 10 is designed in such a manner that spindle 14 displaces the T-shaped mold part 2 to the left about a distance which corresponds to the displacement of the other spindle 15, and hence of the other mold part 3 to the right. The compression springs *9a–9d*** are installed in non-illustrated guides.

Figure 4:
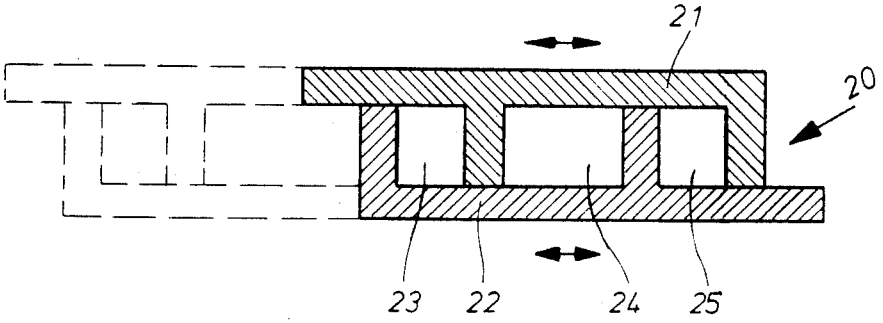
FIG. 4 is a sectional top view of another embodiment of this invention.

Another embodiment of this invention is illustrated in FIG. 4. The adjustable sliding mold 20 is assembled of two like mold parts 21 and 22, each having an F-shaped configuration with interlaced arms. By virtue of this interlaced arrangement there result three parallel extrusion passages 23, 24 and 25, of which the outer passages 23 and 25 change their cross-sectional areas uniformly, whereas the center cross-sectional area is inversely proportional to the adjusted size of the outer areas. Accordingly, this embodiment is suitable for producing twin cast strands of the same size, whereby the center extrusion passage may be unused. Preferably, the position adjustment of the two mold parts 21 and 22 is made in the same manner as explained in the preceding example in FIG. 3. In other words, by the symmetrical displacement of the two mold parts in opposite directions the centers of respective extrusion passages remain stationary and are not dependent on the adjusted cross-sectional size. For the sake of clarity, the compression springs are omitted in FIG. 4.

The two mold parts 21 and 22 are constructed with relatively thick walls for accommodating non-illustrated cooling channels. As a consequence, the mold parts in this embodiment have a negligible elasticity only, and under certain circumstances this may produce problems regarding the proper seal between the contact surfaces.

Figure 5:
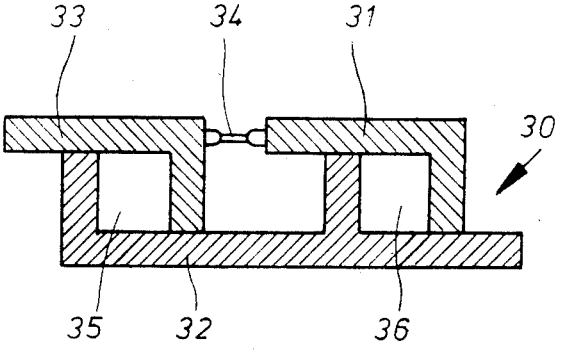
FIG. 5 is a modification of the embodiment of FIG. 4.

The embodiment according to FIG. 5 is a modification of the embodiment of FIG. 4, in which the aforementioned problems concerning the seal between the mold parts are facilitated. In this modification, the sliding mold 30 consists of an F-shaped mold part 32, corresponding to the part 22 in the example of FIG. 4. The other mold part, however, is divided into two L-shaped sections 31 and 33 linked together by a flexible connection 34. The arms of the two L-shaped mold sections are again interleaved with the arms of the opposite F-shaped mold section 32 to form parallel extrusion passages 35 and 36. The symmetrical displacement of the two mold parts is the same as in the examples of FIGS. 3 and 4.

It will be understood that each of the elements described above, or two or more together, may also find a useful application in other types of constructions differing from the types described above. For instance, in a further modification of the embodiment of FIG. 5, the mold part 32 can be designed also of two L-shaped sections similar to the sections 31 and 32 and linked together by a corresponding flexible coupling, so as to form two parallel single channels arranged side-by-side. The adjusting drive is the same as in the preceding examples; that means, the coupled mold parts are displaced in one direction, and the opposite coupled mold parts are driven by the same distance in opposite direction.

When the invention has been illustrated and described as embodied in adjustable sliding molds having flat inner surfaces, it is not intended to be limited to the details shown, since various modifications and structural changes may be made without departing in any way from the spirit of the present invention. For example, this invention is applicable even for the so-called arcuate molds, in which the opposite narrow sides are flat whereas the opposite long sides are curved along a circular section. It will be understood also that the invention is not limited to twin casting installations, but is equally suitable for multi-strand casting devices. It is conceivable, for instances, to design two mutually shiftable mold parts, each having a plurality of interlaced arms, as indicated by dashed lines in FIG. 4.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An adjustable sliding mold for use in continuous casting installations, comprising two angular mold parts slidably engaging each other at two contact surfaces to form an adjustable extrusion channel of a substantially rectangular cross section; one of said two mold parts being formed with at least one arm projecting into said extrusion channel and slidably engaging the opposite mold part at an additional contact surface to subdivide the extrusion channel into a plurality of parallel extrusion passages.

2. A sliding mold as defined in claim 1, wherein one of said mold parts has a substantially T-shaped configuration and the other mold part has a substantially U-shaped configuration whereby the projecting arm of the T-shaped mold part engages the opposite mold part at the additional contact surface.

3. A sliding mold as defined in claim 2, further comprising adjusting drive means coupled to respective mold parts and simultaneously displacing the mold parts about the same distance in opposite directions.

4. A sliding mold as defined in claim 1, wherein each of the two mold parts has an F-shaped configuration with mutually interlaced arms to form three parallel extrusion passages.

5. A sliding mold as defined in claim 4, further comprising adjusting drive coupled to respective mold parts to uniformly displace the same in opposite directions.

6. A sliding mold as defined in claim 4, wherein one of said F-shaped mold parts is assembled of two L-shaped sections linked together by a flexible coupling.

7. A sliding mold as defined in claim 1, wherein the arms of said mold parts bounding said extrusion passages are inclined to define conically converging passages, and at least one of said mold parts being provided with arcuate guiding means to increase the conicity at larger cross-sectional areas.

8. A sliding mold as defined in claim 1, comprising an adjusting drive arranged side-by-side with the mold in the direction of shifting of its mold parts, said adjusting drives including transmission means coupled to respective mold parts for driving the same in opposite directions.

* * * * *